US009809030B2

(12) United States Patent
Suzuki et al.

(10) Patent No.: US 9,809,030 B2
(45) Date of Patent: Nov. 7, 2017

(54) LIQUID EJECTING APPARATUS

(71) Applicant: SEIKO EPSON CORPORATION, Tokyo (JP)

(72) Inventors: Manabu Suzuki, Matsumoto (JP); Tsutomu Sasaki, Matsumoto (JP); Satoru Katagami, Matsumoto (JP); Kazutoshi Fujishima, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/065,536

(22) Filed: Mar. 9, 2016

(65) Prior Publication Data

US 2016/0271953 A1 Sep. 22, 2016

(30) Foreign Application Priority Data

Mar. 20, 2015 (JP) ..... 2015-057822

(51) Int. Cl.
*B41J 2/17* (2006.01)
*B41J 2/185* (2006.01)
*B41J 2/165* (2006.01)

(52) U.S. Cl.
CPC ..... *B41J 2/16517* (2013.01); *B41J 2/1714* (2013.01); *B41J 2/185* (2013.01)

(58) Field of Classification Search
CPC . B41J 2/175; B41J 2/165; B41J 2/1714; B41J 2/185; B41J 29/377; B41J 3/543; B41J 2002/1728; B41J 2002/1853
See application file for complete search history.

(56) References Cited

U.S. PATENT DOCUMENTS 4,959,660 A 9/1990 Suzuki et al.
5,296,873 A * 3/1994 Russell ..... B41J 2/1714 101/424.1
6,281,910 B1 * 8/2001 Nakano ..... B41J 29/377 347/34
6,322,196 B1 * 11/2001 Lim ..... B41J 2/16508 347/35
7,905,571 B2 * 3/2011 Byun ..... B41J 2/1721 347/20
8,201,936 B2 * 6/2012 Ihara ..... B41J 2/14274 347/102

(Continued)

FOREIGN PATENT DOCUMENTS

JP 2004-237691 8/2004
JP 2005-0271316 10/2005

(Continued)

OTHER PUBLICATIONS

European Search Report for Application No. 16159621.8 dated Sep. 9, 2016.

*Primary Examiner* — Anh T. N. Vo
(74) *Attorney, Agent, or Firm* — Workman Nydegger

(57) ABSTRACT

A liquid ejecting apparatus which includes an ejecting unit which ejects liquid, and a collecting unit which collects mist which occurs along with ejecting of the liquid from the ejecting unit from a collecting port, in which the collecting unit includes a backflow prevention unit in the collecting port. By adopting such a liquid ejecting apparatus, it is possible to suppress backflow of mist of the liquid from the collecting unit which collects mist of the liquid which occurs along with ejecting of liquid from the ejecting unit.

8 Claims, 18 Drawing Sheets

(56) References Cited

U.S. PATENT DOCUMENTS

| | | | | |
|---|---|---|---|---|
| 2008/0143781 | A1* | 6/2008 | Inoue | B41J 2/1714 347/34 |
| 2011/0025789 | A1 | 2/2011 | Kuwata et al. | |
| 2014/0292921 | A1 | 10/2014 | Tanaka | |

FOREIGN PATENT DOCUMENTS

| | | |
|---|---|---|
| JP | 2007-229950 | 9/2007 |
| JP | 2007-0229950 | 9/2007 |

* cited by examiner

LIQUID EJECTING APPARATUS

BACKGROUND

1. Technical Field

The present invention relates to a liquid ejecting apparatus.

2. Related Art

In the related art, a liquid ejecting apparatus which ejects liquid such as ink onto a medium such as a medium for recording has been disclosed. In such a liquid ejecting apparatus, there is a case in which mist of the liquid is attached to an ejecting unit of the liquid, or the like, is accumulated, and contaminates a medium by dripping on the medium. For this reason, a technology in which attaching of liquid to an ejecting unit, or the like, is suppressed is disclosed.

For example, in JP-A-2007-229950, and JP-A-2004-237691, a liquid ejecting apparatus which includes a collecting unit which collects mist of ink which occurs along with ejecting of ink from an ejecting unit is disclosed.

However, even when a collecting unit which collects mist is provided, there has been a case in which mist which is collected in the collecting unit once flows back from the collecting unit to the ejecting unit side due to an occurrence of turbulence in the collecting unit.

In the liquid ejecting apparatus in JP-A-2007-229950, and JP-A-2004-237691, it is possible to preferably collect mist of ink which occurs along with ejecting of ink from the ejecting unit; however, there is no description about mist which flows back from the collecting unit to the ejecting unit side.

SUMMARY

An advantage of some aspects of the invention is to suppress backflow of mist of liquid from a collecting unit which collects mist of the liquid which occurs along with ejecting of the liquid from an ejecting unit.

According to an aspect of the invention, there is provided a liquid ejecting apparatus including an ejecting unit which ejects liquid; and a collecting unit which collects mist which occurs along with ejecting of the liquid from the ejecting unit from a collecting port, in which the collecting unit includes a backflow prevention unit in the collecting port.

In the liquid ejecting apparatus, the backflow prevention unit may include a rotating unit, and a regulation unit which regulates rotating of the rotating unit in a direction which goes toward the outside from the inside of the collecting unit, in which the rotating unit may be able to open or close the collecting port by being rotated, the collecting port may be closed due to the rotating unit when the rotating unit is at a position of being regulated by the regulation unit, and the collecting port may be opened when the rotating unit is at a position of not being regulated by the regulation unit.

In the liquid ejecting apparatus, a backflow prevention space in which backflow of mist which is caused by an occurrence of turbulence in an air current which is generated along with collecting of the mist from the collecting port is suppressed may be provided inside the collecting unit.

The liquid ejecting apparatus may further include an inducing unit which induces the mist toward the collecting port.

In the liquid ejecting apparatus, the collecting unit may include a suctioning unit which generates an air current from the collecting port toward the inside of the collecting unit.

The liquid ejecting apparatus may further include an air blowing unit which blows air from the outside of the collecting unit toward the collecting port.

In the liquid ejecting apparatus, the ejecting unit may be able to eject the liquid while reciprocating in a reciprocating direction, and the air blowing unit may stop air blowing when the ejecting unit is moving in the reciprocating direction, and may perform air blowing when the ejecting unit is stopped.

In the liquid ejecting apparatus, the ejecting unit may be able to eject the liquid while reciprocating in the reciprocating direction, and the suctioning unit may maintain a suctioning state in both cases of a case in which the ejecting unit is moving in the reciprocating direction and a case in which the ejecting unit is stopped.

The liquid ejecting apparatus may further include an air blowing unit which blows air from the outside of the collecting unit toward the collecting port, in which the collecting unit may include a suctioning unit which generates an air current from the collecting port toward the inside of the collecting unit, and a wind velocity of an air current which goes from the outside of the collecting unit toward the collecting port by interposing the collecting port may be lower than a wind velocity of an air current which goes from the collecting port toward the inside of the collecting unit.

According to the aspects of the invention, it is possible to suppress backflow of mist of liquid from a collecting unit which collects mist of the liquid which occurs along with ejecting of the liquid from an ejecting unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

FIGS. 1 to 16

Hereinafter, a recording apparatus according to one embodiment as a liquid ejecting apparatus of the invention will be described in detail with reference to accompanying drawings.

First, an outline of a recording apparatus 1 according to a first embodiment of the invention will be described.

Figure 1:
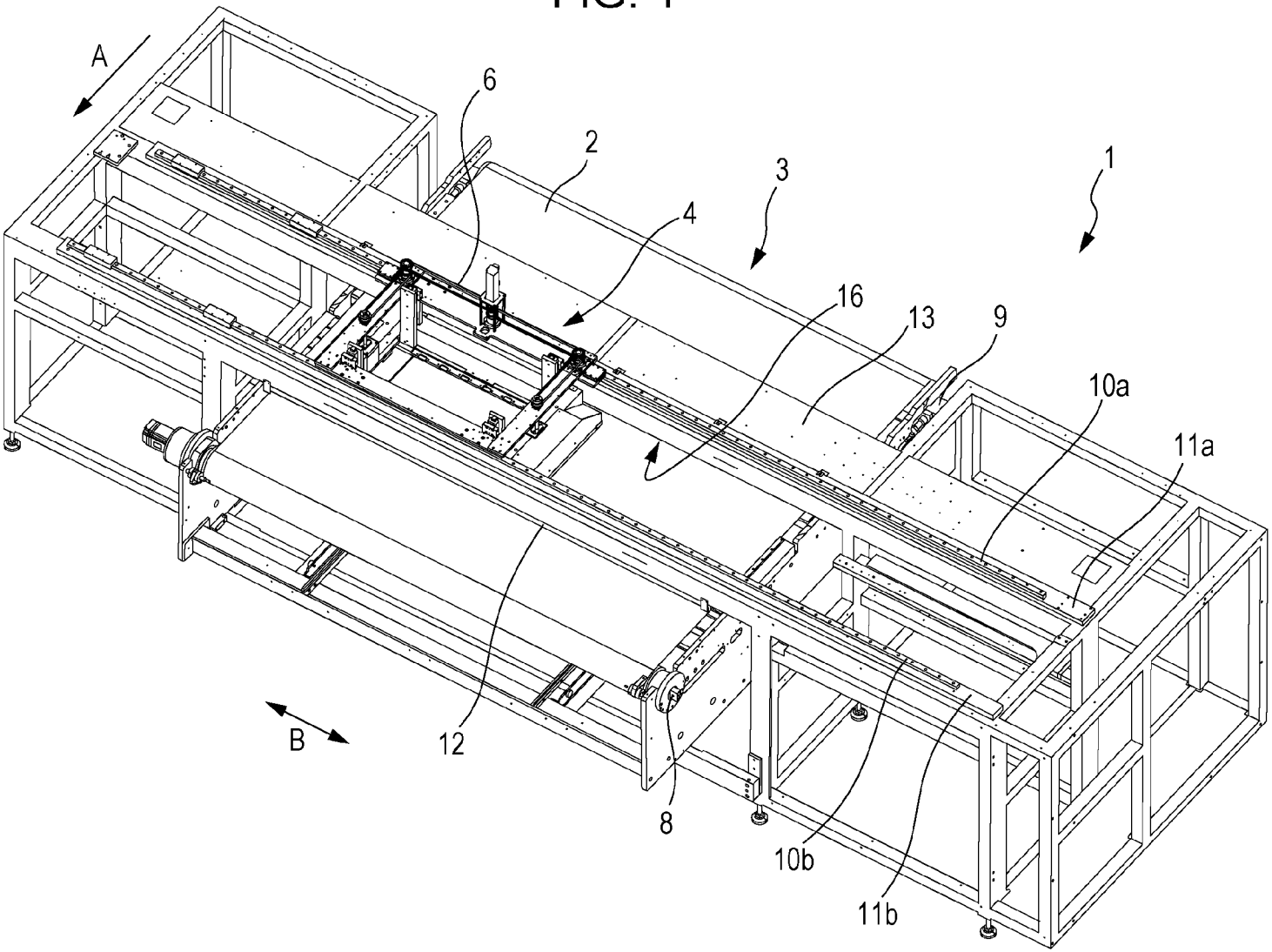
FIG. 1 is a schematic perspective view which illustrates a recording apparatus according to a first embodiment of the invention.
Figure 2:
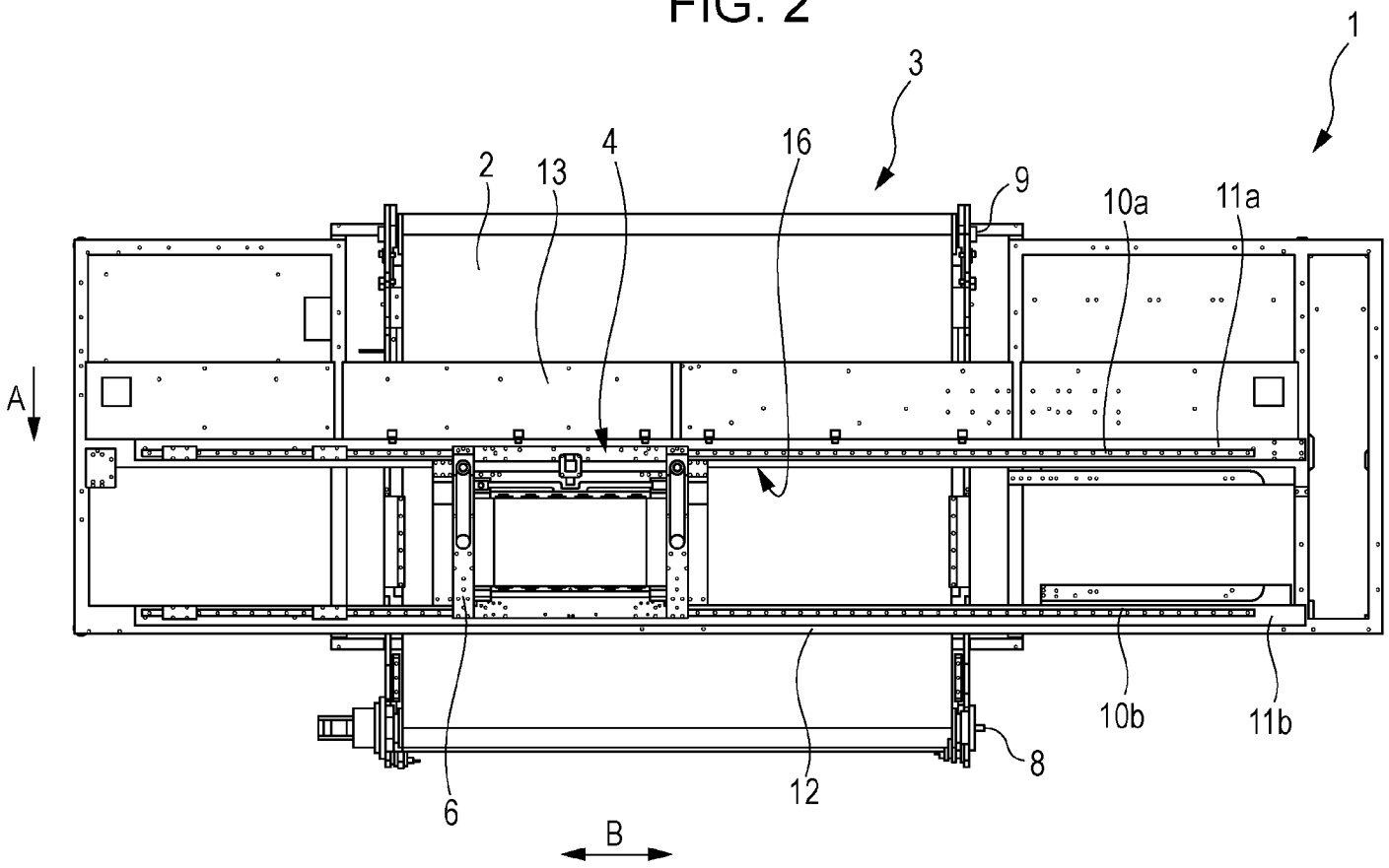
FIG. 2 is a schematic plan view which illustrates the recording apparatus according to the first embodiment of the invention.
Figure 3:
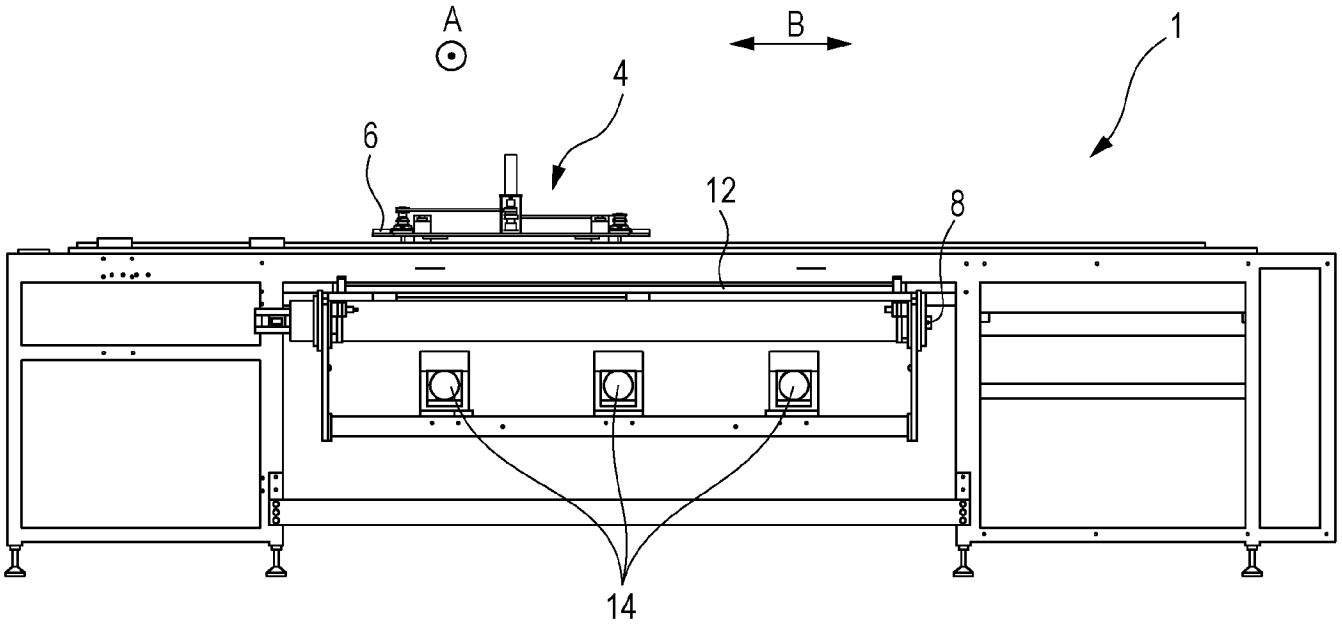
FIG. 3 is a schematic front view which illustrates the recording apparatus according to the first embodiment of the invention.
Figure 4:
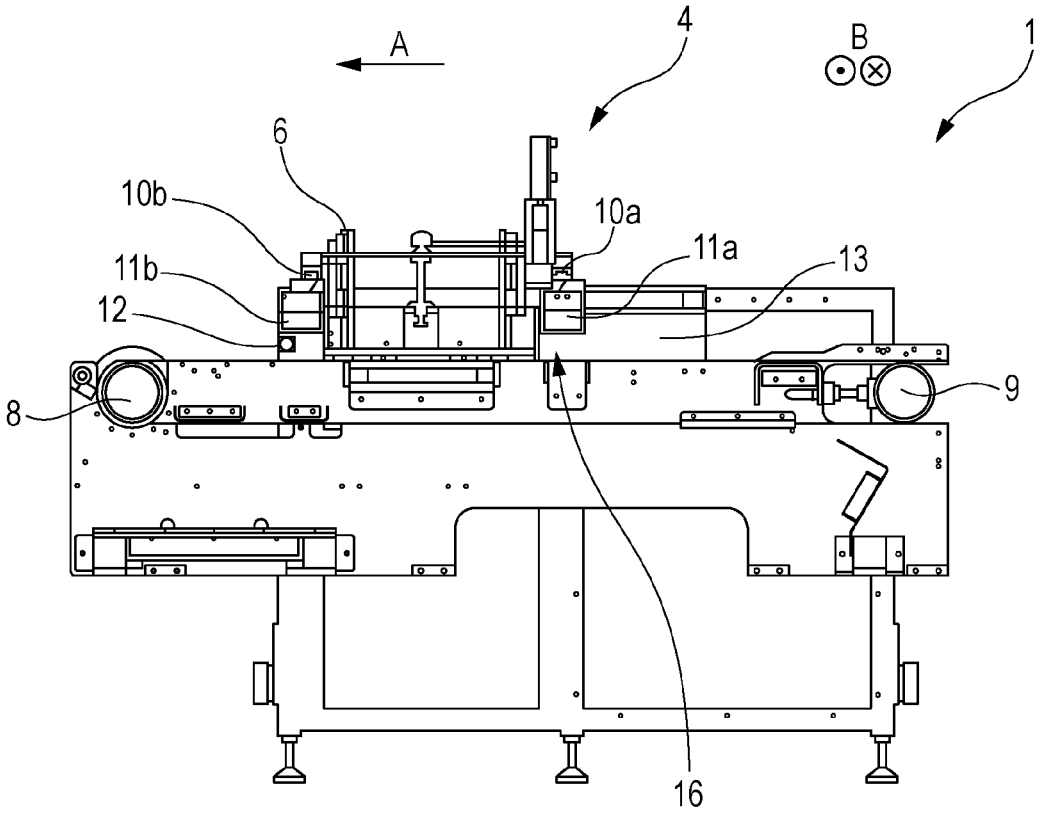
FIG. 4 is a schematic side view which illustrates the recording apparatus according to the first embodiment of the invention.
Figure 5:
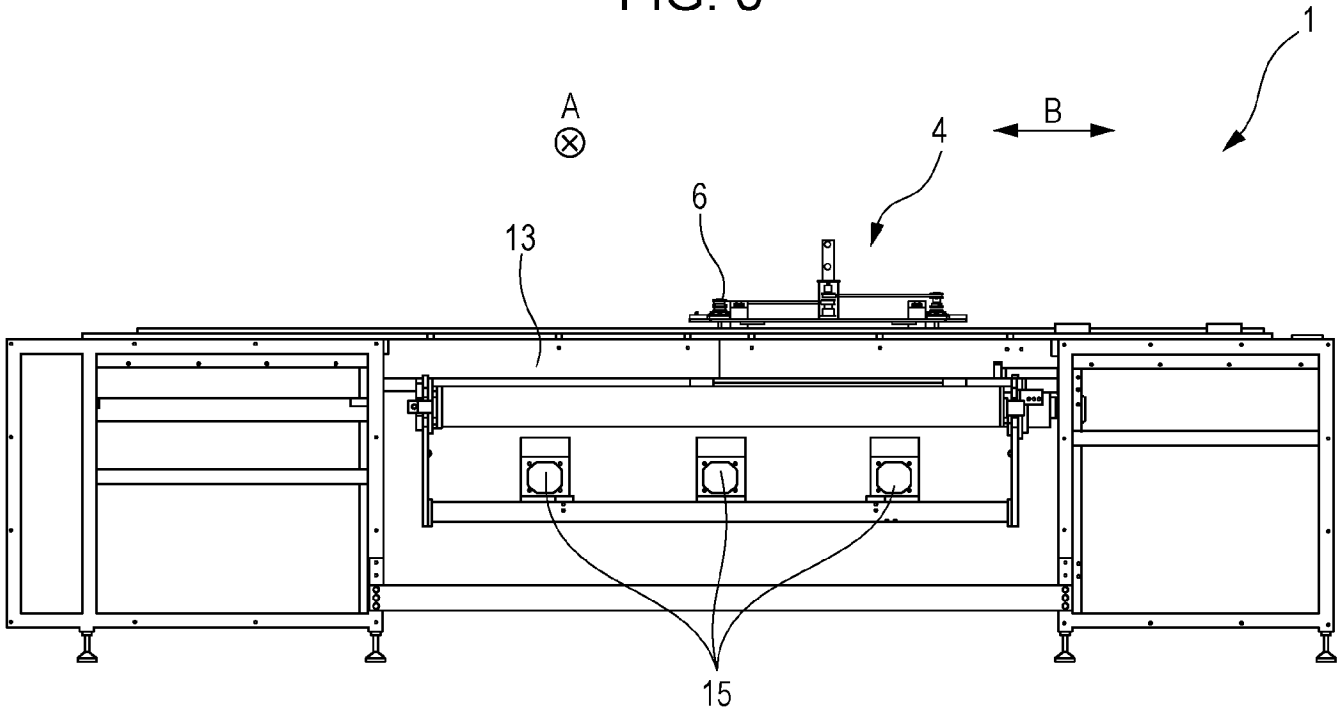
FIG. 5 is a schematic rear view which illustrates the recording apparatus according to the first embodiment of the invention.
Figure 6:
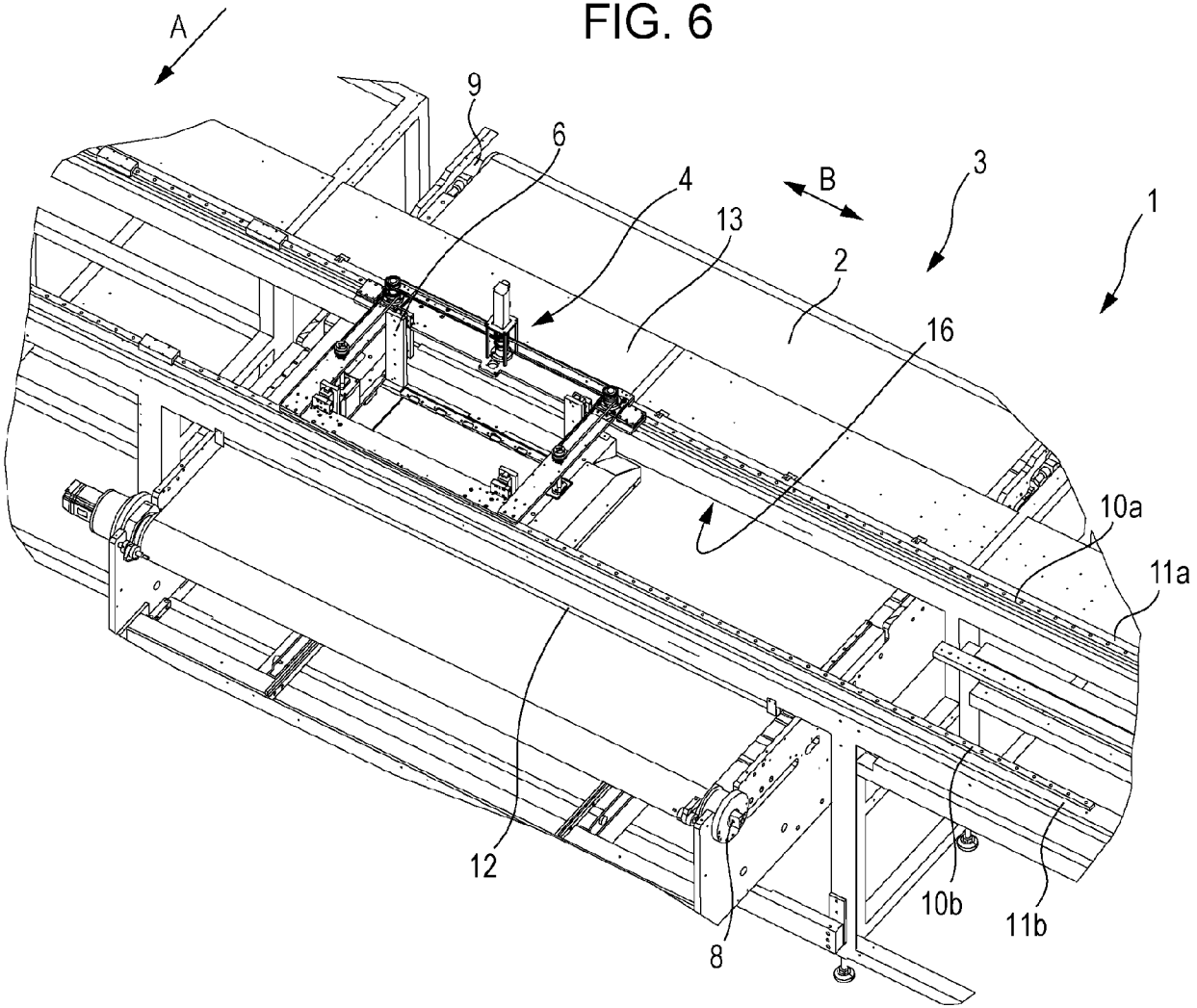
FIG. 6 is a schematic perspective view which illustrates main portions of the recording apparatus according to the first embodiment of the invention.

FIG. 1 is a schematic perspective view of a recording apparatus 1 according to the embodiment. FIG. 2 is a schematic plan view of the recording apparatus 1 according to the embodiment. FIG. 3 is a schematic front view of the recording apparatus 1 according to the embodiment. FIG. 4 is a schematic side view of the recording apparatus 1 according to the embodiment. FIG. 5 is a schematic rear view of the recording apparatus 1 according to the embodiment. In addition, FIG. 6 is a schematic perspective view which illustrates the periphery of a recording region which is main portions of the recording apparatus 1 according to the embodiment. In addition, FIGS. 1 to 6 illustrate a state in which a part of constituent elements is detached from the recording apparatus 1 according to the embodiment, and for example, illustrate a state in which a sub-carriage 5 (refer to FIG. 12) which includes a recording head 7 (refer to FIG. 11) is detached from a carriage 6.

The recording apparatus 1 according to the embodiment includes a transport mechanism 3 which transports a medium for recording in a transport direction A using an adhesive belt 2 (endless belt) which supports the medium for recording (medium) on a support face to which an adhesive is attached. The recording apparatus further includes a feeding unit (not illustrated) on which a medium for recording in a roll shape can be set, and can feed the medium for recording to the transport mechanism 3. The recording apparatus further includes a recording mechanism 4 which performs recording by causing the carriage 6 which includes the recording head 7 as the ejecting unit to perform reciprocating scanning in a reciprocating direction B which intersects the transport direction A, in a transport region of the medium for recording using the transport mechanism 3. The recording apparatus further includes a winding mechanism (not illustrated) which can winds up the medium for recording on which recording is performed in the recording mechanism 4.

The transport mechanism 3 according to the embodiment includes the adhesive belt 2 which transports the medium for recording which is fed from the feeding unit by mounting the medium for recording thereon, a driving roller 8 which moves the adhesive belt 2, and a driven roller 9. The medium for recording is mounted on a support face of the adhesive belt 2 by being attached.

However, an endless belt as a transport belt is not limited to the adhesive belt. For example, an electrostatic suctioning-type endless belt may be used.

The recording apparatus 1 according to the embodiment includes the transport mechanism 3 with such a configuration; however, it is not limited to the transport mechanism with such a configuration, and may be a transport mechanism with a configuration in which a medium for recording is transported by being supported by a movable support tray, or the like, or a configuration in which a medium for recording is transported using a pair of rollers, or the like. In addition, it may be a recording apparatus of a so-called flatbed type in which recording is performed by fixing a medium for recording to a support unit, and a recording head 7 is moved with respect to the fixed medium for recording.

The recording mechanism 4 includes a carriage motor 30 (refer to FIG. 7) which causes the carriage 6 which includes the recording head 7 which can eject ink (liquid) to reciprocate in the reciprocating direction B.

The recording apparatus 1 according to the embodiment performs recording by causing the carriage 6 which includes the recording head 7 to perform reciprocating scanning when performing recording; however, the transport mechanism 3 stops transporting of the medium for recording in the middle of recording scanning (in the middle of moving of carriage 6). In other words, when performing recording, reciprocating scanning of the carriage 6, and transporting of the medium for recording are alternately performed. That is, when performing recording, the transport mechanism 3 causes the medium for recording to be intermittently transported (intermittent movement of adhesive belt 2) corresponding to reciprocating scanning of the carriage 6.

In addition, a rail 10*a* which extends in the reciprocating direction B is formed in a pipe 11*a* which configures a skeleton portion of the recording apparatus 1 according to the embodiment, and a rail 10*b* which extends in the reciprocating direction B is formed in a pipe 11*b* which configures a skeleton portion of the recording apparatus 1 according to the embodiment. In addition, a movement of the carriage 6 according to the embodiment in the reciprocating direction B is guided by the rails 10*a* and 10*b*, since bearing units (not illustrated) are received in the rails 10*a* and 10*b*.

In addition, an air blowing unit 12 which extends in the reciprocating direction B, and blows air in a direction opposite to the transport direction A from a plurality of vents (not illustrated) is provided at a position on the lower part of the pipe 11*b*. In addition, a mist collecting unit 13 which extends in the reciprocating direction B, and can collect mist of ink which is ejected from the recording head 7 is provided at a position on the lower part of the pipe 11*a*. In addition, a collecting port 16 which extends in the reciprocating direction B is provided in the mist collecting unit 13 at the position on the lower part of the pipe 11*a*.

In addition, as illustrated in FIG. 3, a plurality of blower fans 14 (three) which generate a blasting force using the air blowing unit 12 are provided on the downstream side of the recording apparatus 1 according to the embodiment in the transport direction A. The air blowing unit 12 can blow air toward the collecting port 16 from the outside (position on downstream side in transport direction A) of the collecting unit 13 using the blast force which is generated by the blower fan 14. In addition, as illustrated in FIG. 5, a plurality of (three) suctioning fans 15 as a suctioning unit which generate an air current from the collecting port 16 toward the inside of the collecting unit 13, and from the inside of the collecting unit 13 toward the outside of the recording apparatus 1 are provided on the upstream side of the recording apparatus 1 according to the embodiment in the transport direction A.

Subsequently, an electrical configuration of the recording apparatus 1 according to the embodiment will be described.

Figure 7:
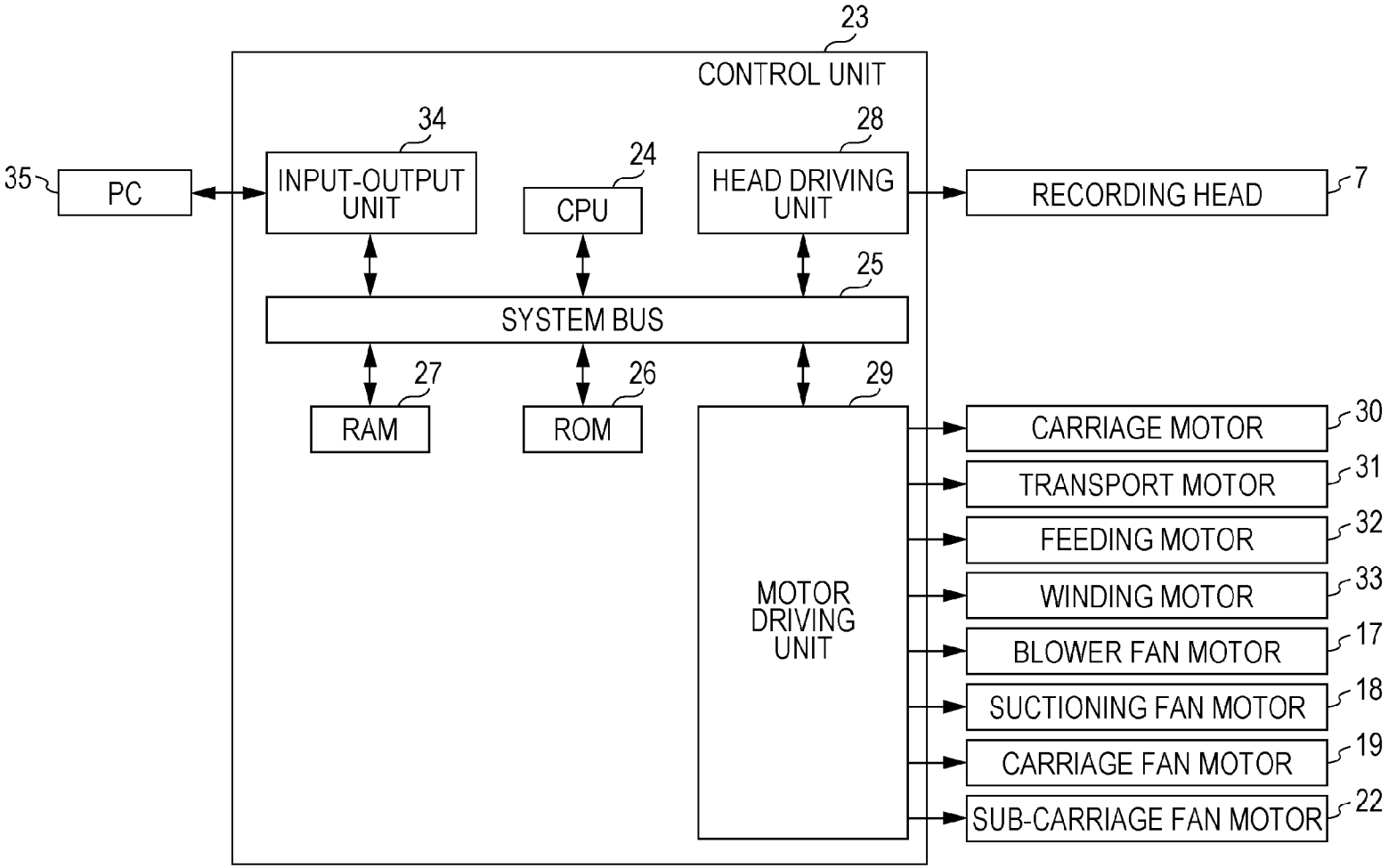
FIG. 7 is a block diagram which illustrates the recording apparatus according to the first embodiment of the invention.

FIG. 7 is a block diagram of the recording apparatus 1 according to the embodiment.

A CPU 24 which is in charge of the entire control of the recording apparatus 1 is provided in a control unit 23. The CPU 24 is connected to a ROM 26 which stores various control programs, and the like, which are executed by the CPU 24, and a RAM 27 which can temporarily store data through a system bus 25.

In addition, the CPU 24 is connected to a head driving unit 28 which drives the recording head 7 through the system bus 25.

In addition, the CPU 24 is connected to a motor driving unit 29 for driving the carriage motor 30, a transport motor 31, a feeding motor 32, a winding motor 33, a blower fan motor 17, a suctioning fan motor 18, a carriage fan motor 19, and a sub-carriage fan motor 22 through the system bus 25.

Here, the carriage motor 30 is a motor for moving the carriage 6 including the recording head 7. In addition, the transport motor 31 is a motor for driving the driving roller 8. The feeding motor 32 is a driving motor of a feeding unit which blows out a medium for recording which is set in the feeding unit (not illustrated) to the transport mechanism 3. The winding motor 33 is a driving motor for driving a winding mechanism (not illustrated) in order to wind up a medium for recording on which recording is performed. The blower fan motor 17 is a motor for driving the blower fan 14. The suctioning fan motor 18 is a motor for driving the suctioning fan 15. The carriage fan motor 19 is a motor for driving a carriage fan 20 (refer to FIG. 8) which will be described later. In addition, the sub-carriage fan motor 22 is a motor for driving a sub-carriage fan 21 (refer to FIG. 12) which will be described later.

In addition, the CPU 24 is connected to an input-output unit 34 through the system bus 25, and the input-output unit 34 is connected to a PC 35 for performing transceiving of data such as recording data, and a signal.

Subsequently, the carriage 6 of the recording apparatus 1 according to the embodiment will be described.

Figure 8:
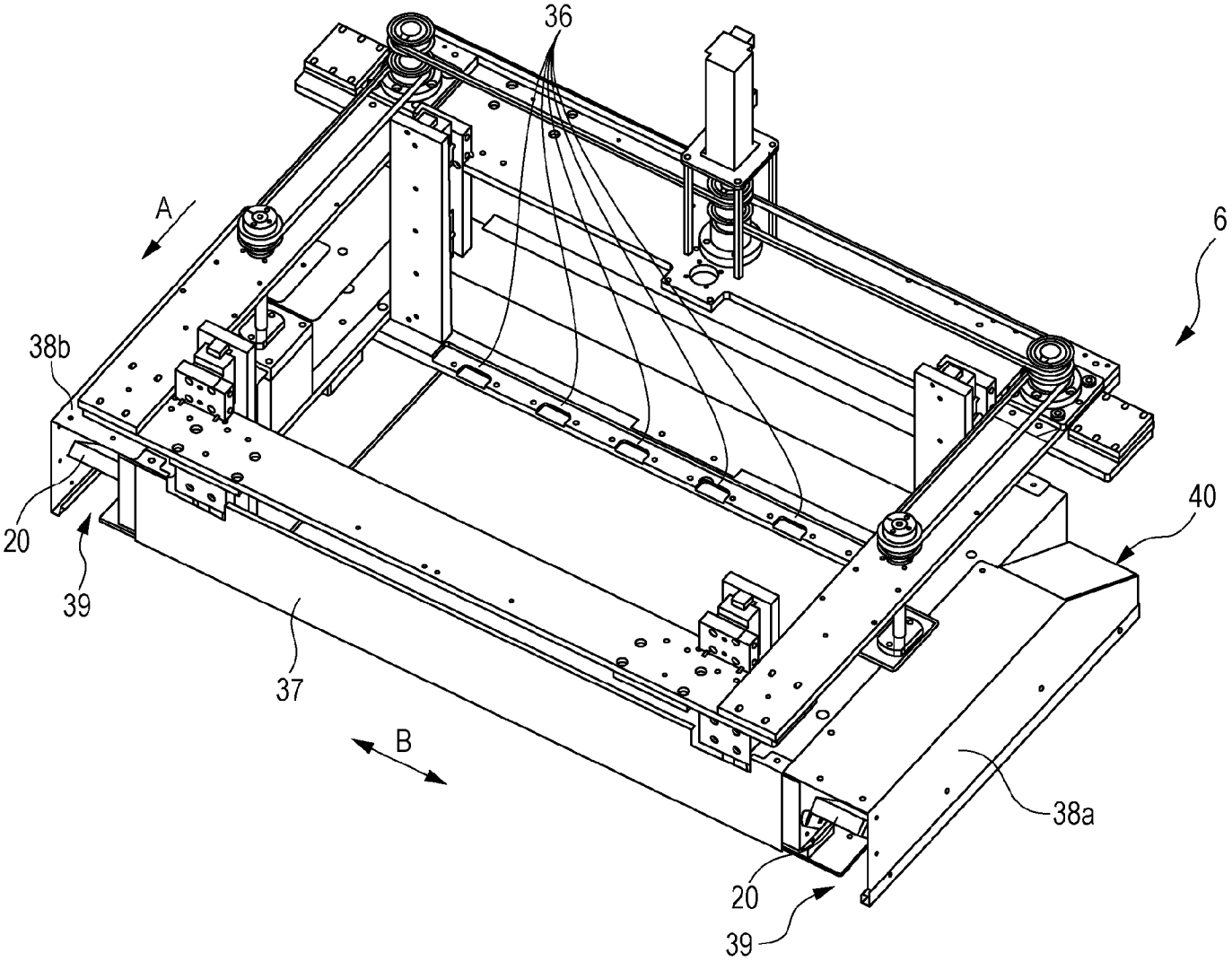
FIG. 8 is a schematic perspective view which illustrates a carriage of the recording apparatus according to the first embodiment of the invention.
Figure 9:
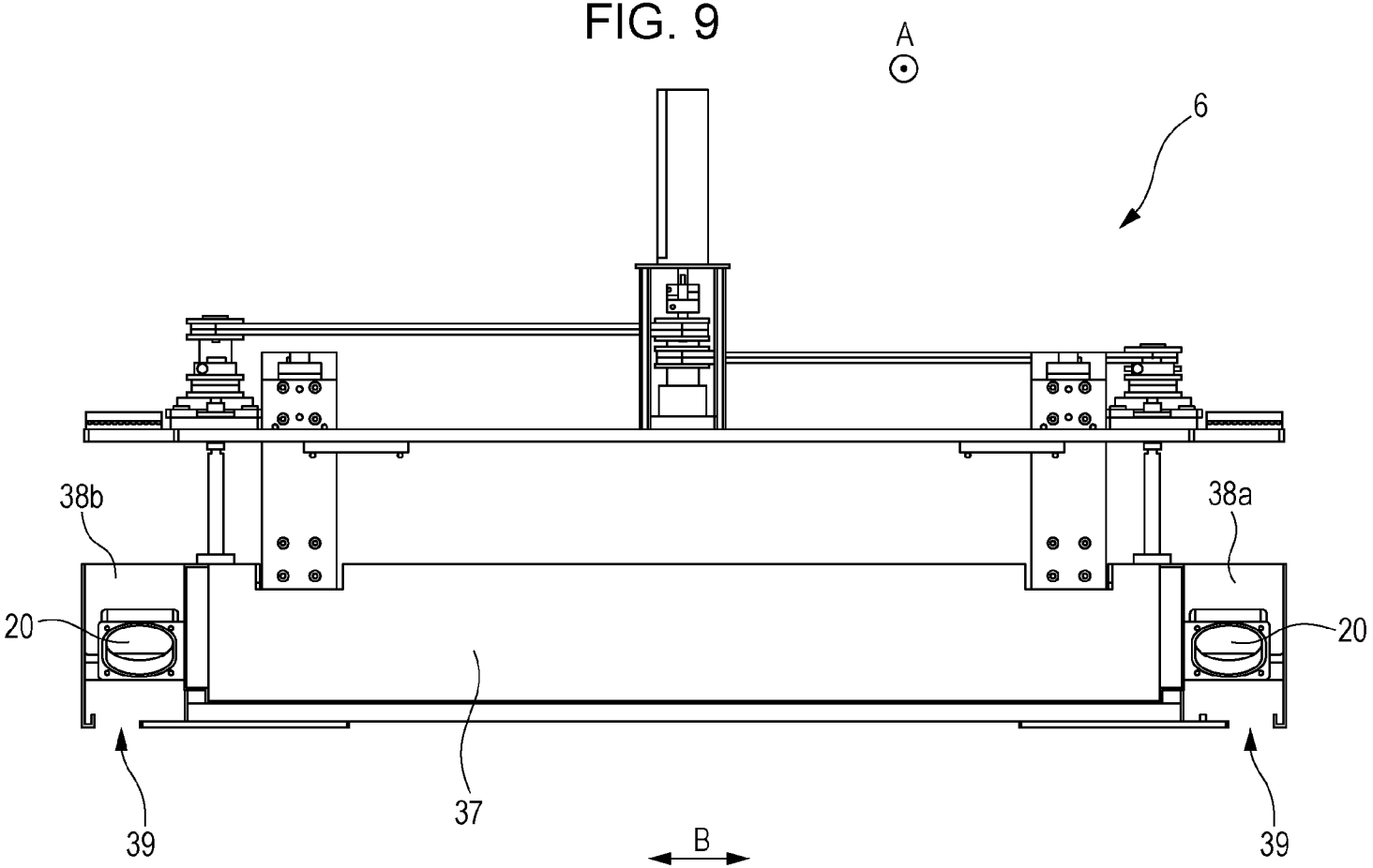
FIG. 9 is a schematic front view which illustrates the carriage of the recording apparatus according to the first embodiment of the invention.
Figure 10B:
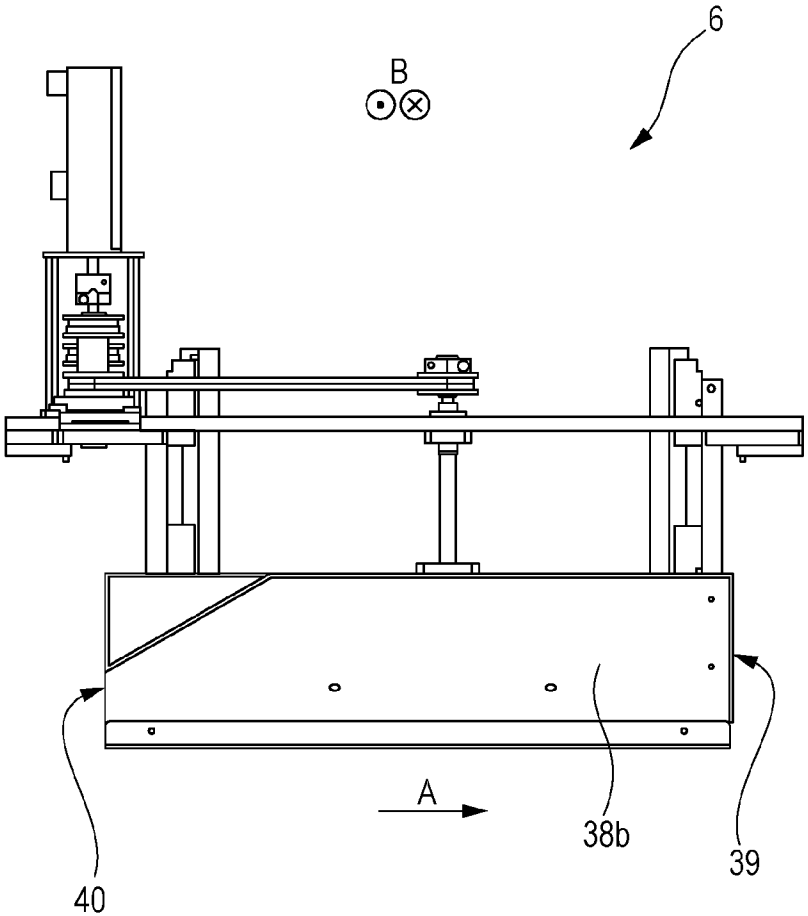
FIGS. 10A and 10B are schematic side views which illustrate the carriage of the recording apparatus according to the first embodiment of the invention.
Figure 10A:
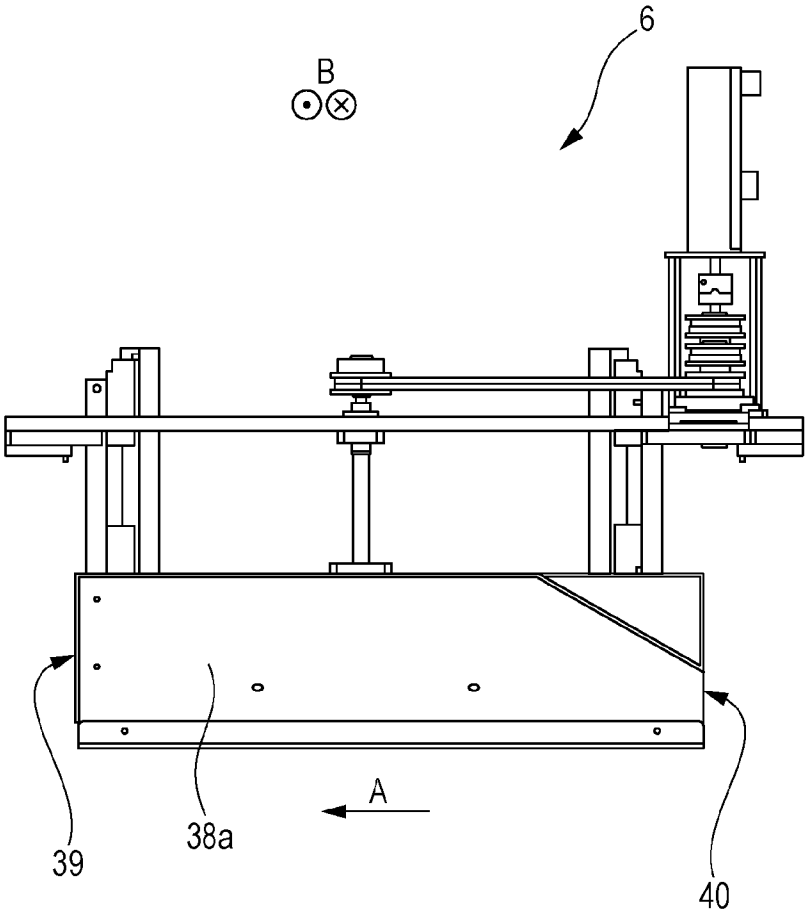
Figure 11:
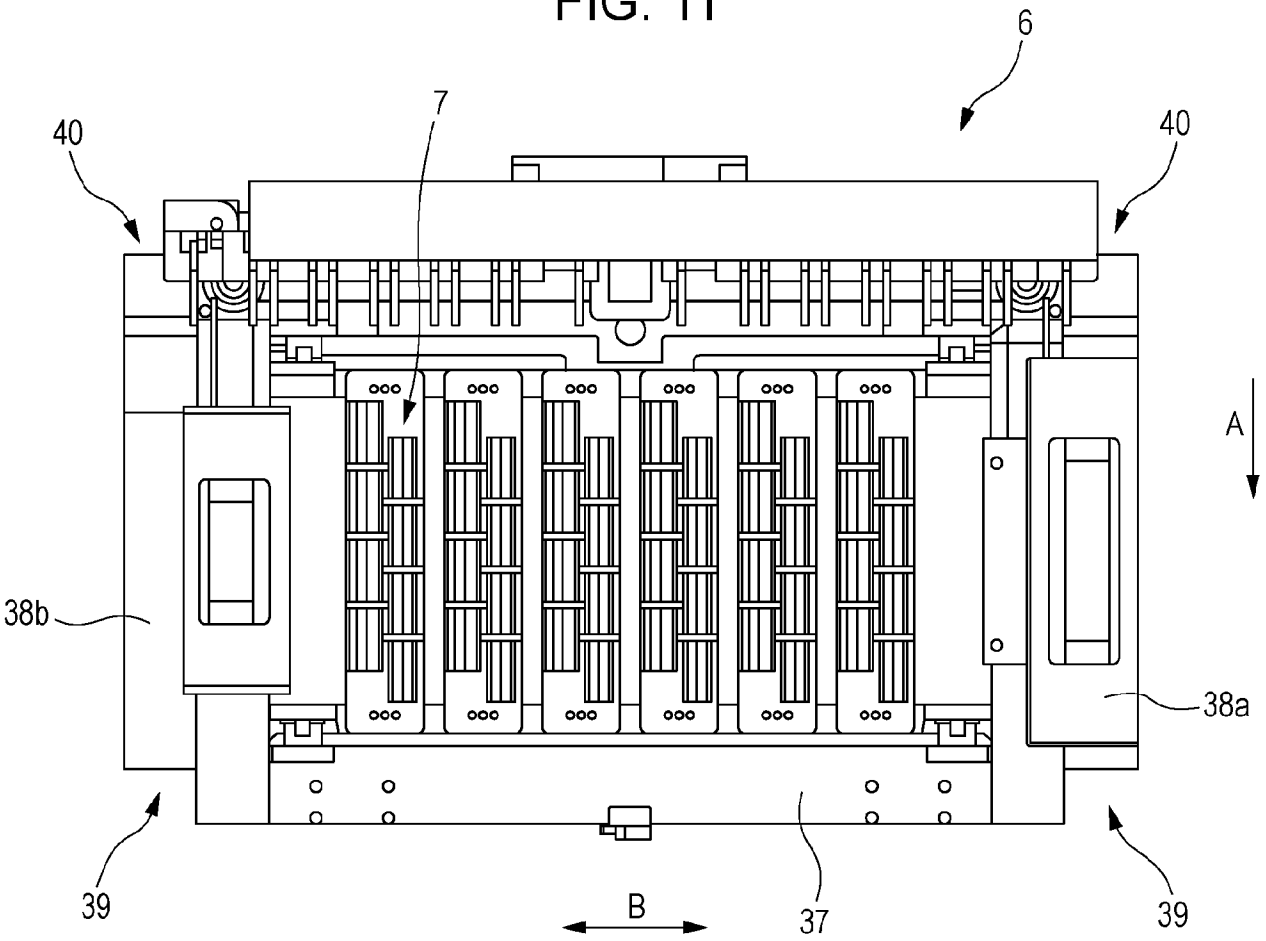
FIG. 11 is a schematic plan view which illustrates the carriage of the recording apparatus according to the first embodiment of the invention.
Figure 12:
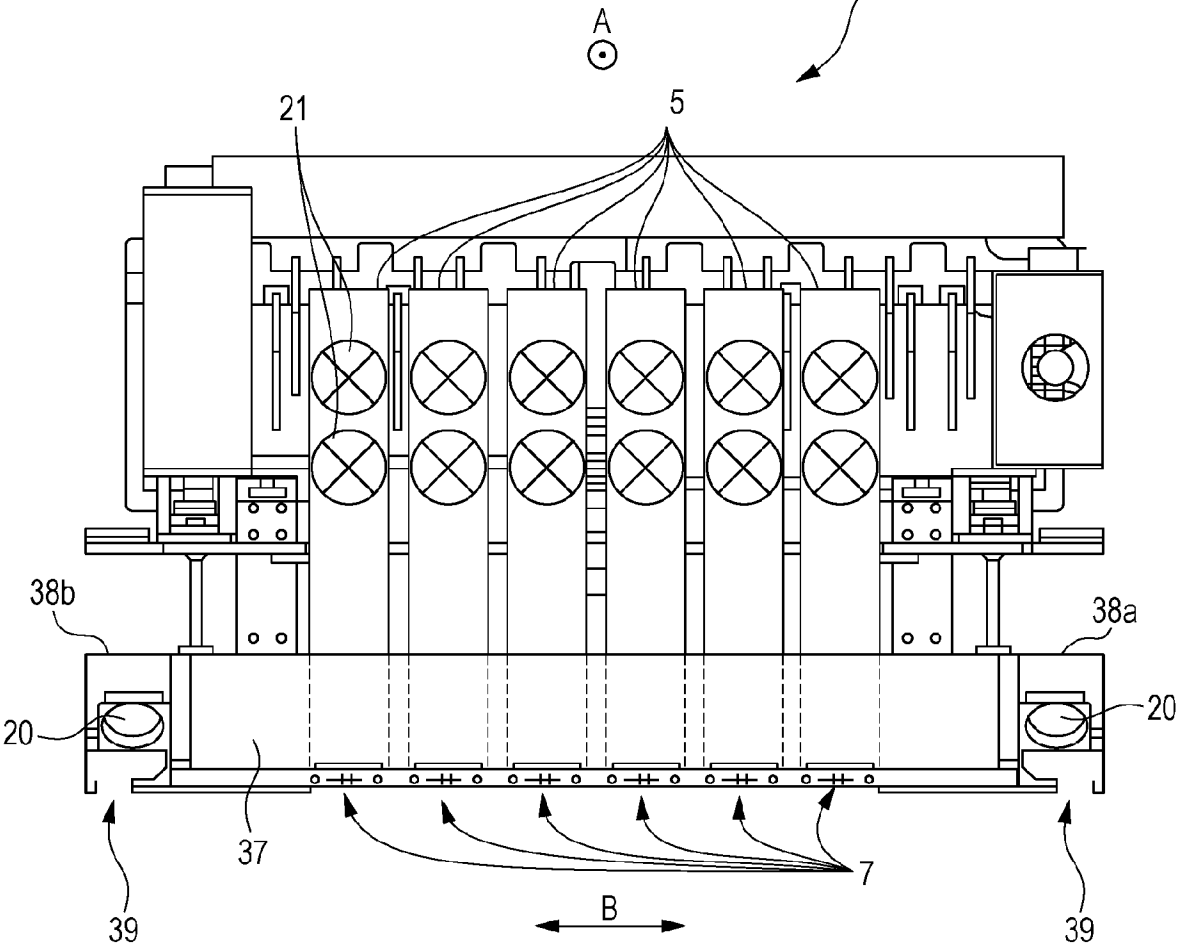
FIG. 12 is a schematic front view which illustrates the carriage of the recording apparatus according to the first embodiment of the invention.
Figure 13:
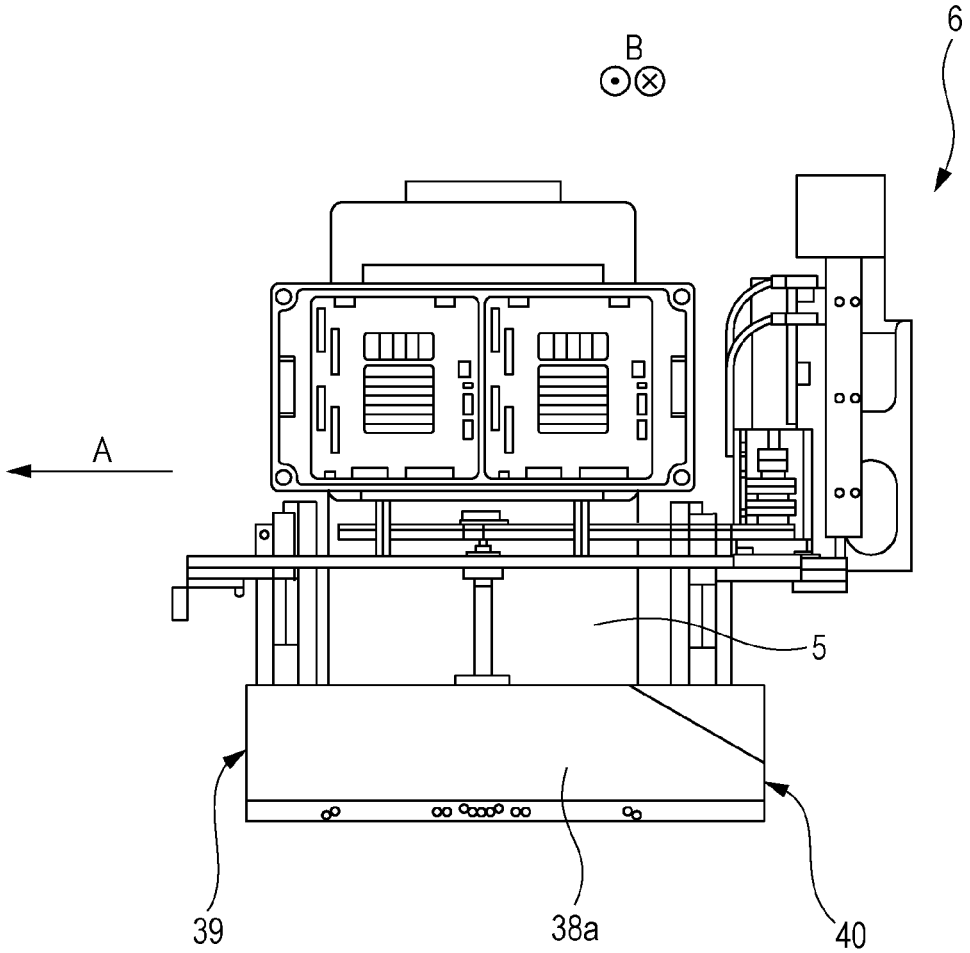
FIG. 13 is a schematic side view which illustrates the carriage of the recording apparatus according to the first embodiment of the invention.

FIGS. 8 to 13 illustrate a schematic view of the carriage 6 according to the embodiment. Among these, FIG. 8 is a schematic perspective view of the carriage 6 according to the embodiment, FIGS. 9 and 12 are schematic front views of the carriage 6 according to the embodiment, FIGS. 10A and 10B, and 13 are schematic side view of the carriage 6 according to the embodiment, and FIG. 11 is a schematic plan view of the carriage 6 according to the embodiment. In addition, FIGS. 8 to 10B illustrate a state in which a part of constituent elements, for example, a sub-carriage 5 which includes the recording head 7 is detached from the carriage 6. In addition, FIGS. 11 to 13 illustrate a state in which a plurality of the sub-carriages 5 including the recording heads 7 are attached to the carriage 6; however, FIG. 11 is set to a perspective view so that it is possible to understand arrangements of the plurality of recording heads 7 which are provided in each sub-carriage 5. In addition, FIG. 10A in FIGS. 10A and 10B is a schematic side view of the carriage 6 on the right side when viewed from the front side, and FIG. 10B is a schematic side view of the carriage 6 on the left side when viewed from the front side.

As illustrated in FIGS. 11 and 12, the carriage 6 according to the embodiment can be attached with the plurality of (six) sub-carriages 5. In addition, as illustrated in FIG. 11, the plurality of recording heads 7 are arranged in staggered manner in each sub-carriage 5. In addition, a substrate, or the like, is formed in the inside of each sub-carriage 5, in addition to the plurality of recording heads 7, and the sub-carriage fan 21 for cooling the substrate is provided in the sub-carriage.

Since the sub-carriage fan 21 suppresses an increase in temperature in the sub-carriage 5 by blowing (air blowing) an air current in the inside of the sub-carriage 5, when mist of ink is present around the sub-carriage fan 21, the mist is sent to the inside of the sub-carriage 5, and there is a concern that the mist may be attached to the substrate, or the like.

For this reason, in the recording apparatus 1 according to the embodiment, the air blowing unit 12 and the collecting unit 13 are provided as described above in order to suppress attaching of mist to the substrate, or the like.

In addition, an attaching unit 36 of the sub-carriage 5 is provided in the carriage 6 according to the embodiment, as illustrated in FIG. 8.

In addition, as illustrated in FIGS. 8, 9, 11, and 12, a frame-shaped unit 37 for suppressing attaching of mist of ink which is ejected from the recording head 7, which flies up to the higher part to the sub-carriage 5 is provided. The frame-shaped unit 37 takes a role as a separator which maintains the region on the higher part of the sub-carriage 5 so as to be a region with little mist, by suppressing soaring up of mist with respect to a region which is close to the recording head 7, and has much mist.

In addition, as illustrated in FIGS. 8 to 13, air current generation units 38*a* and 38*b* in which the carriage fan 20 is provided are provided on the outer side of the frame-shaped unit 37 in the reciprocating direction B. In other words, in the air current generation units 38*a* and 38*b* which are provided on the outer side of the frame-shaped unit 37, the carriage fan 20 which generates an air current toward the opening portion 40 on the upstream side in the transport direction A is provided in the vicinity of the opening portion 39 which is provided on the downstream side in the transport direction A.

Here, the carriage 6 according to the embodiment can move mist in the vicinity of the carriage 6 by driving the carriage fan 20 in the middle of a recording operation (in the middle of ejecting ink from recording head 7 while moving carriage 6 in reciprocating direction B) under a control of the control unit 23.

In addition, as illustrated in FIGS. 8, 10A and 10B, and 13, the air current generation units 38*a* and 38*b* have a tapered shape in which a length in the height direction becomes small toward the opening portion 40 on the upstream side in the transport direction A.

Subsequently, the collecting unit 13 as a main portion of the recording apparatus 1 according to the embodiment will be described.

Figure 14:
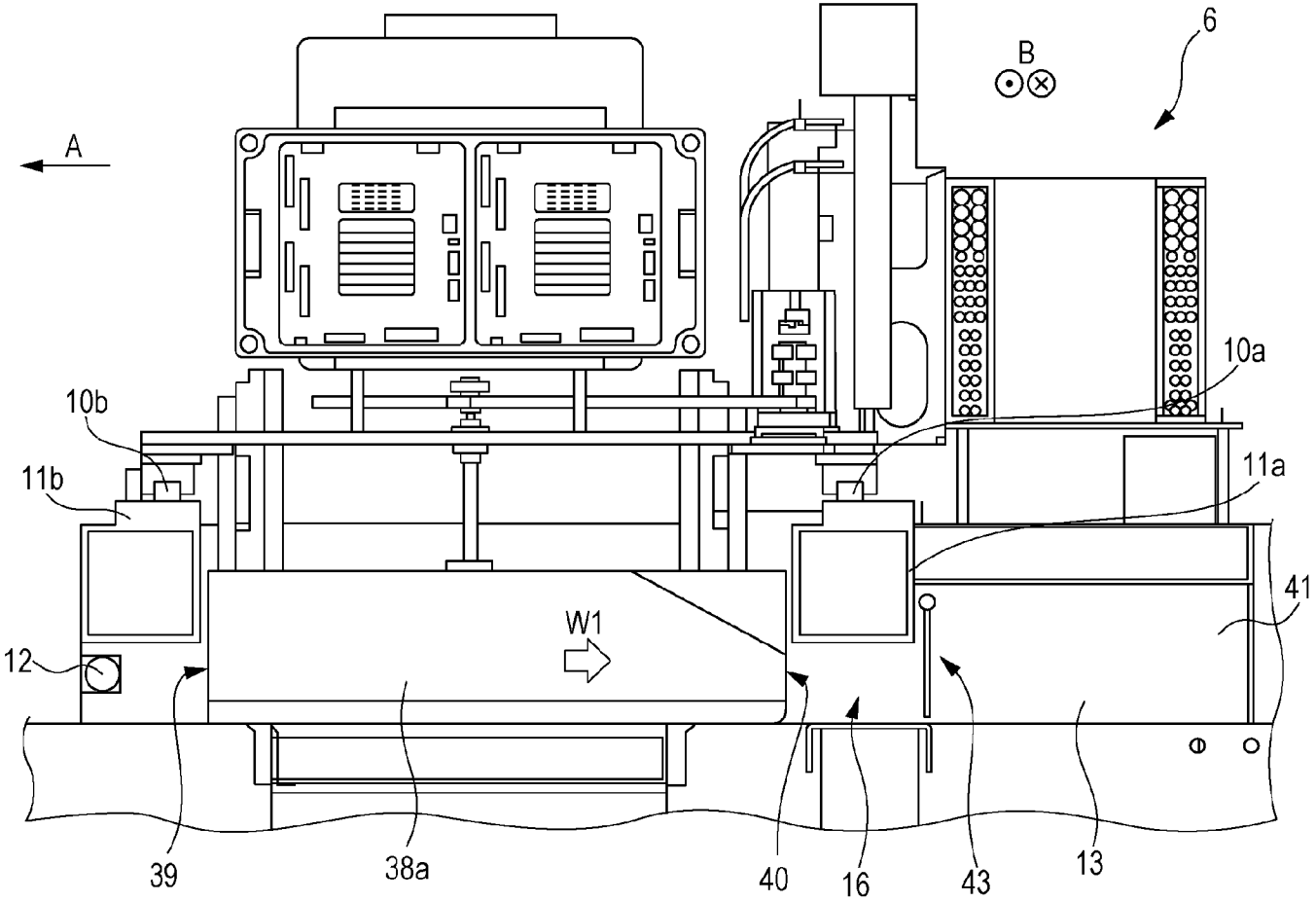
FIG. 14 is a schematic side sectional view which illustrates main portions of the recording apparatus according to the first embodiment of the invention.
Figure 15:
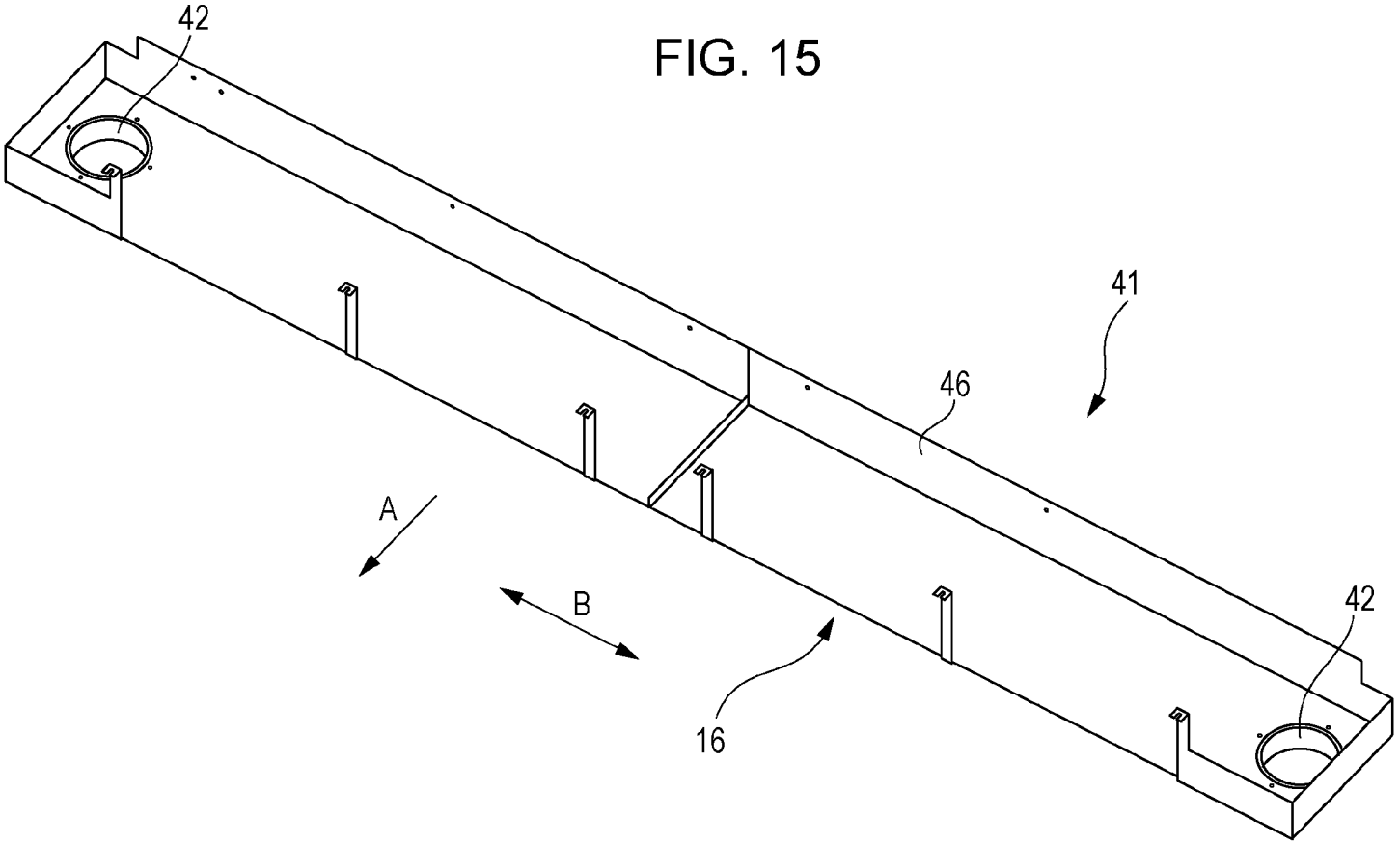
FIG. 15 is a schematic perspective view which illustrates a collecting unit of the recording apparatus according to the first embodiment of the invention.
Figure 16B:
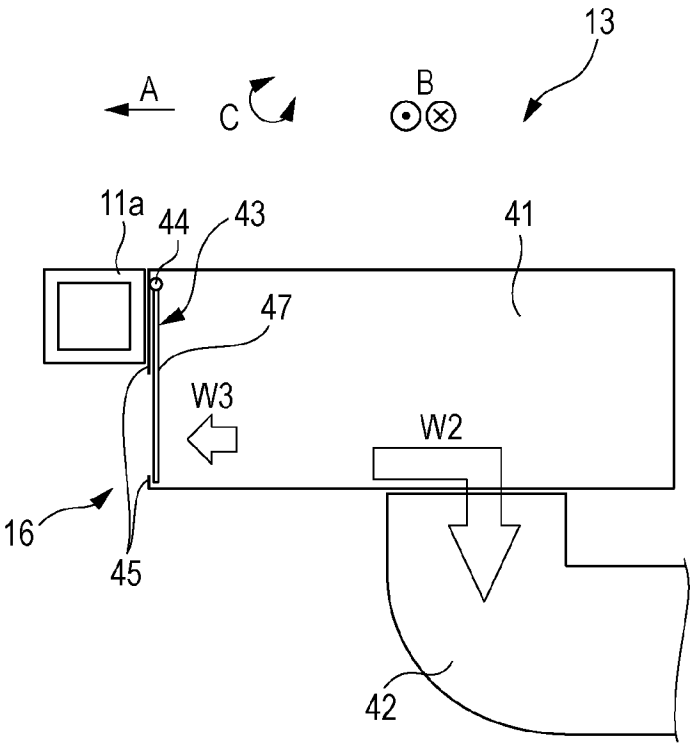
FIGS. 16A and 16B are schematic side sectional views which illustrate a peripheral unit of the collecting unit of the recording apparatus according to the first embodiment of the invention.
Figure 16A:
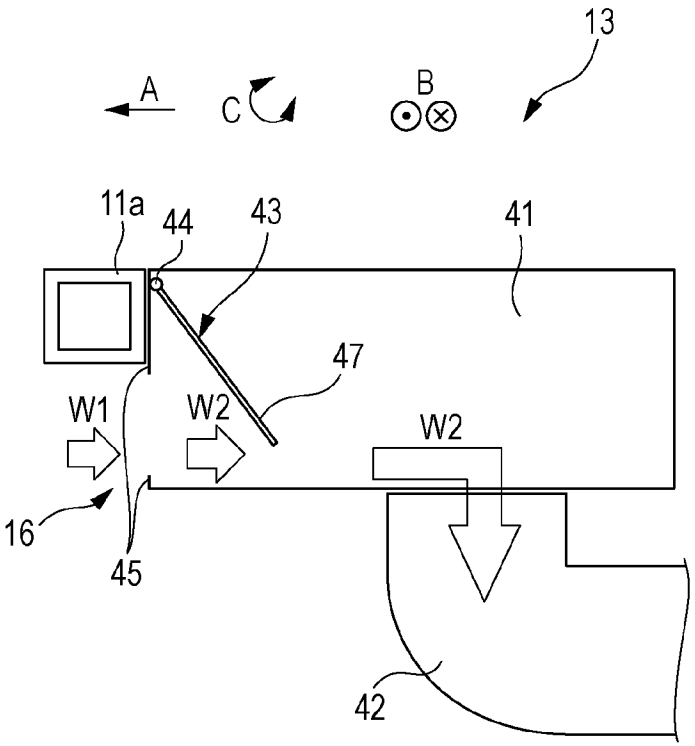

Here, FIG. 14 is a schematic side sectional view of main portions of the recording apparatus 1 according to the embodiment for describing a positional relationship among the collecting unit 13, the carriage 6, and the air blowing unit 12 in the embodiment. FIG. 15 is a schematic perspective view which illustrates the collecting chamber 41 in the inside of the collecting unit 13. FIGS. 16A and 16B are schematic side sectional views of peripheral portions of the collecting unit 13. In addition, FIG. 16A in FIGS. 16A and 16B is a schematic side sectional view when recording is not performed (state in which ink is not ejected from recording head 7), and FIG. 16B is a schematic side sectional view when recording is performed.

As illustrated in FIG. 14, in the transport direction A, the air blowing unit 12 which can blow the air current W1 toward the upstream side in the transport direction A is provided on the downstream side of a movement region (corresponding to recording region) of the carriage 6 in the reciprocating direction B, and the collecting unit 13 is provided on the upstream side of the recording region. By arranging the collecting unit 13 in this manner, it is possible to efficiently collect mist of ink which occurs in the recording region.

In addition, as described above, the recording apparatus 1 according to the embodiment includes the recording head 7 which ejects ink, and the collecting unit 13 which collects mist which occurs along with ejecting of ink from the recording head 7, from the collecting port 16; however, as illustrated in FIGS. 14 to 16B, the collecting unit 13 includes a backflow prevention unit 43 in the collecting port 16. For this reason, the recording apparatus 1 according to the embodiment can suppress backflow of mist of ink from the collecting unit 13 to the recording region.

Specifically, as illustrated in FIGS. 16A and 16B, the backflow prevention unit 43 includes the rotating unit 47 which rotates in a rotating direction C based on a rotating shaft 44 which is provided in the collecting chamber 41 in the inside of the collecting unit 13, and which goes along the reciprocating direction B, and a regulation unit 45 which regulates a rotation of the rotating unit 47 in a direction which goes toward the outside from the inside of the collecting unit 13 (direction toward which air current W3 goes). In addition, the rotating unit 47 can open or close the collecting port 16 by being rotated, and is configured so that the collecting port 16 is closed due to the rotating unit 47 when the rotating unit is located at a position of being regulated by the regulation unit 45, as illustrated in FIG. 16B, and the collecting port 16 is opened when the rotating unit 47 is located at a position of not being regulated by the regulation unit 45, as illustrated in FIG. 16A. With such a simple configuration, backflow of mist of ink from the collecting unit 13 is suppressed.

More specifically, in the recording apparatus 1 according to the embodiment, the recording head 7 can eject ink while reciprocating in the reciprocating direction B; however, the air blowing unit 12 can stop air blowing during a movement of the recording head 7 in the reciprocating direction B, and can blow air when the recording head 7 is stopped under a control of the control unit 23. That is, it is possible to set so that air blowing is stopped while ink is ejected from the recording head 7 (during recording operation), and air blowing is performed while ink is not ejected from the recording head 7.

Here, FIG. 16A illustrates a state in which the air blowing unit 12 blows air while ink is not ejected from the recording head 7. As illustrated in FIG. 16A, the collecting port 16 is opened when the backflow prevention unit 43 moves upward due to the air current W1 which is sent from the air blowing unit 12, and the collecting unit 13 can collect mist in the inside from the outside of the collecting unit 13. Meanwhile, FIG. 16B illustrates a state in which air blowing from the air blowing unit 12 is stopped while ink is not ejected from the recording head 7. As illustrated in FIG. 16B, the collecting port 16 is closed when the backflow prevention unit 43 moves downward due to blowing of the air current W1 from the air blowing unit 12, and the collecting unit 13 can suppress backflow of mist from the inside of the collecting unit 13 to the outside (shuts off air current W3 which goes toward backflow direction).

For this reason, the recording apparatus 1 according to the embodiment can collect mist while suppressing an occurrence of a shift in ejecting position of ink (landing position with respect to medium for recording) which is ejected from the recording head 7.

In addition, as described above, the recording apparatus 1 according to the embodiment includes the suctioning fan 15 as illustrated in FIG. 5; however, the suctioning fan 15 is connected to the collecting chamber 41 through a duct 42 which is illustrated in FIGS. 15 to 16B. In other words, the collecting unit 13 includes the suctioning fan 15 as a suctioning unit which generates the air current W2 from the collecting port 16 toward the inside of the collecting unit 13. For this reason, the recording apparatus 1 according to the embodiment can preferably suppress backflow of mist of ink from the collecting unit 13.

As described above, since the recording apparatus 1 according to the embodiment includes the air blowing unit 12 which blows air from the outside of the collecting unit 13 toward the collecting port 16, it is possible to efficiently induce mist toward the collecting unit 13.

As described above, the recording apparatus 1 according to the embodiment has a configuration in which the recording head 7 can eject ink while reciprocating in the reciprocating direction B; however, the suctioning fan 15 can maintain a suctioning state in both situations of in the middle of moving in the reciprocating direction B and in the middle of stopping of the carriage 6 (recording head 7) under a control of the control unit 23. That is, it is possible to set the suctioning fan 15 to a constant suctioning state. Since there is no shift in ejecting position of ink even when the air current W2 is generated inside the collecting unit 13 using the suctioning fan 15, the recording apparatus 1 according to the embodiment can preferably suppress backflow of mist of ink from the collecting unit 13 while suppressing an occurrence of a shift in ejecting position of ink which is ejected from the recording head 7 by setting the suctioning fan 15 to a constant suctioning state.

As described above, the recording apparatus 1 according to the embodiment includes the air blowing unit 12 which generates the air current W1 from the outside of the collecting unit 13 toward the collecting port 16, and the collecting unit 13 includes the suctioning fan 15 which generates the air current W2 from the collecting port 16 toward the inside of the collecting unit 13; however, a wind velocity of the air current W1 which goes from the outside of the collecting unit 13 toward the collecting port 16 by interposing the collecting port 16 is set to be lower than a wind velocity of the air current W2 which goes from the collecting port 16 toward the inside of the collecting unit 13. That is, it is configured so that a wind velocity of the air current W2 which goes from the collecting port 16 toward the inside of the collecting unit 13 is higher than a wind velocity of the air current W1 which goes from the outside of the collecting unit 13 toward the collecting port 16 based on a position of the collecting port 16. For this reason, the recording apparatus 1 according to the embodiment can preferably suppress backflow of mist of ink from the collecting unit 13 by suppressing a situation in which the air current W1 including mist is incapable of entering the collecting unit 13 as a whole.

As illustrated in FIG. 14, the collecting unit 13 according to the embodiment has a configuration in which the collecting chamber 41 is formed by mounting the pipe 11*a* which configures a top face on a base portion 46 which is illustrated in FIG. 15, which configures a constituting region of the collecting port 16, and each face other than a top face; however, it is not limited to such a configuration.

Second Embodiment

FIG. 17

Subsequently, a recording apparatus according to a second embodiment of the invention will be described.

Figure 17:
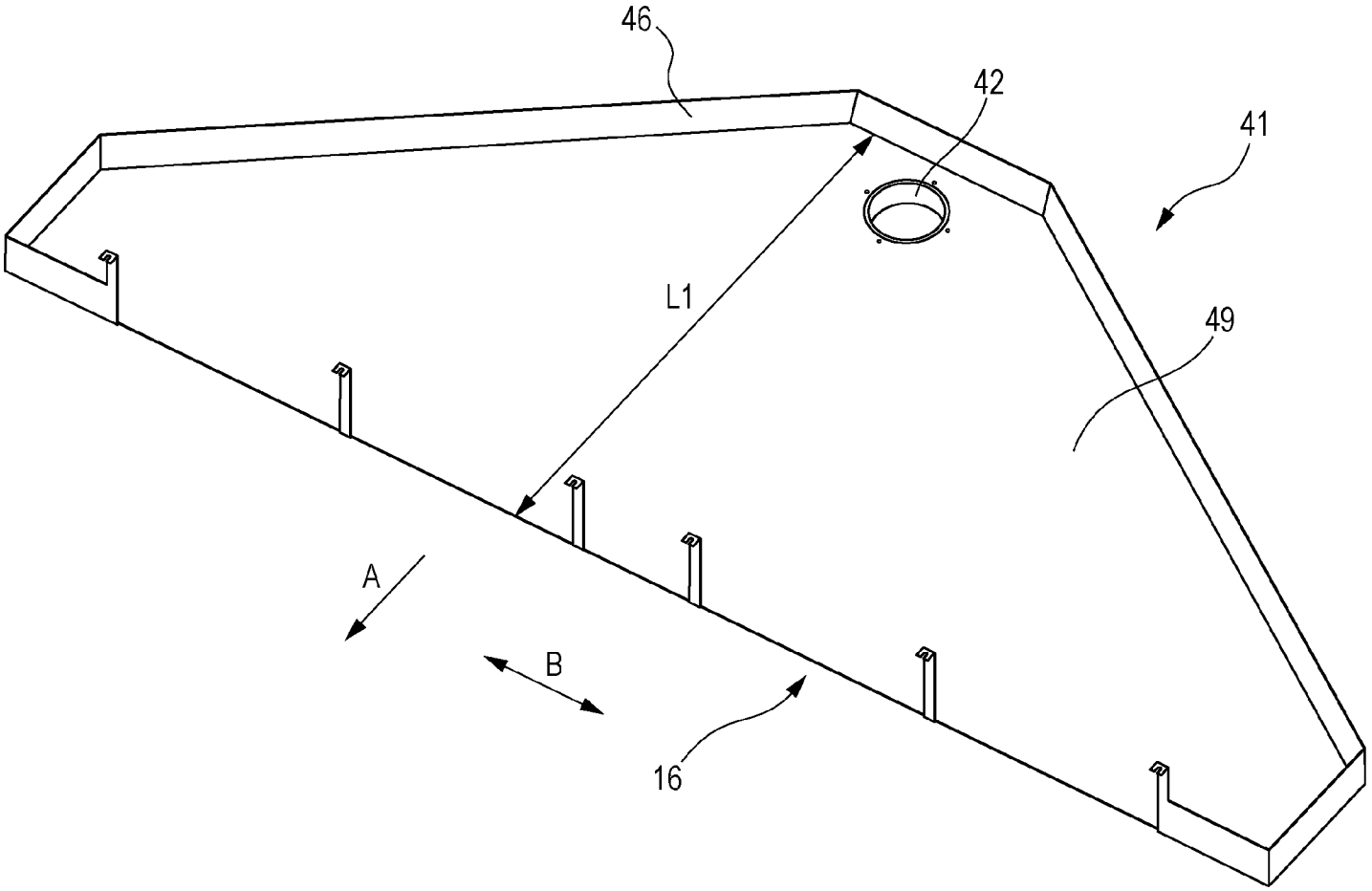
FIG. 17 is a schematic perspective view which illustrates a collecting unit of a recording apparatus according to a second embodiment of the invention.

FIG. 17 is a schematic perspective view which illustrates a collecting chamber 41 in the inside of a collecting unit 13 which is a main portion of a recording apparatus 1 according to the second embodiment of the invention, and corresponds to FIG. 15 which illustrates the collecting chamber 41 in the inside of the collecting unit 13 which is a main portion of the recording apparatus 1 according to the first embodiment.

In addition, constituent elements which are common to those in the first embodiment will be given the same reference numerals, and detailed descriptions will be omitted.

Only a difference in the recording apparatus 1 according to the embodiment from the recording apparatus 1 according to the first embodiment is a configuration of the collecting unit 13.

As it is clear when comparing FIG. 15 and FIG. 17, the collecting chamber 41 of the collecting unit 13 according to the embodiment is wider than the collecting chamber 41 of the collecting unit 13 according to the first embodiment. In other words, a backflow prevention space 49 in which backflow of mist which is caused by an occurrence of turbulence in the air current W2 which is generated along with collecting of the mist of ink from the collecting port 16 is suppressed (suppressing generating of air current W3 which goes from inside of collecting unit 13 toward outside) is provided inside the collecting unit 13 according to the embodiment. That is, the collecting unit 13 is provided with a sufficiently wide space in the inside so that mist does not flow back due to an occurrence of turbulence in the air current W2. For this reason, the recording apparatus 1 according to the embodiment has a configuration in which it is possible to preferably suppress backflow of mist of ink from the collecting unit 13.

In addition, a range of the backflow prevention space 49 in the inside of the collecting unit 13 may not be definite in a boundary thereof, when it is possible to suppress backflow of mist which is caused by an occurrence of turbulence in the air current W2 which occurs along with collecting of mist of ink from the collecting port 16. However, it is preferable to set a length L1 in a depth direction from the collecting port 16 in the inside of the collecting unit 13 to 50 cm or more at a largest portion in order to exert such an effect.

Third Embodiment

Figure 18B:
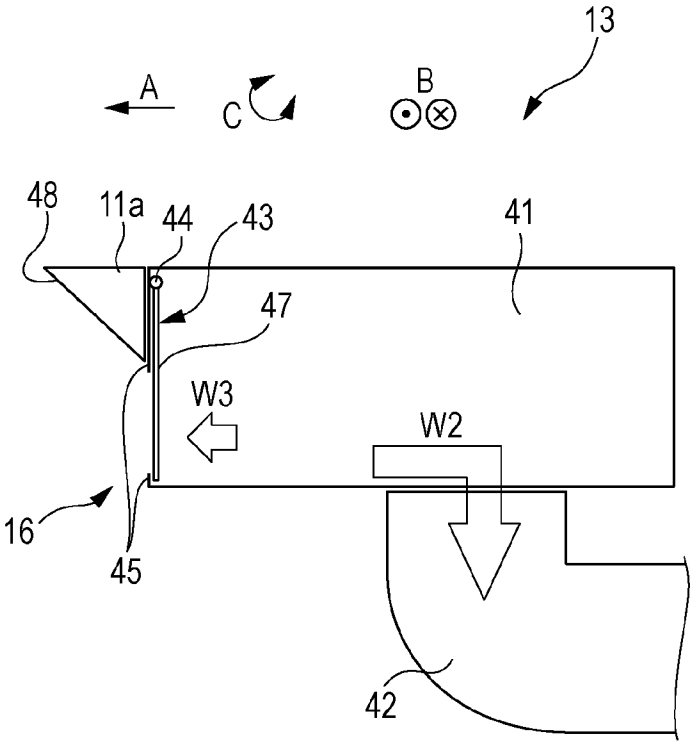
FIGS. 18A and 18B are schematic side sectional views which illustrate a peripheral unit of a collecting unit of a recording apparatus 1 according to a third embodiment of the invention.
Figure 18A:
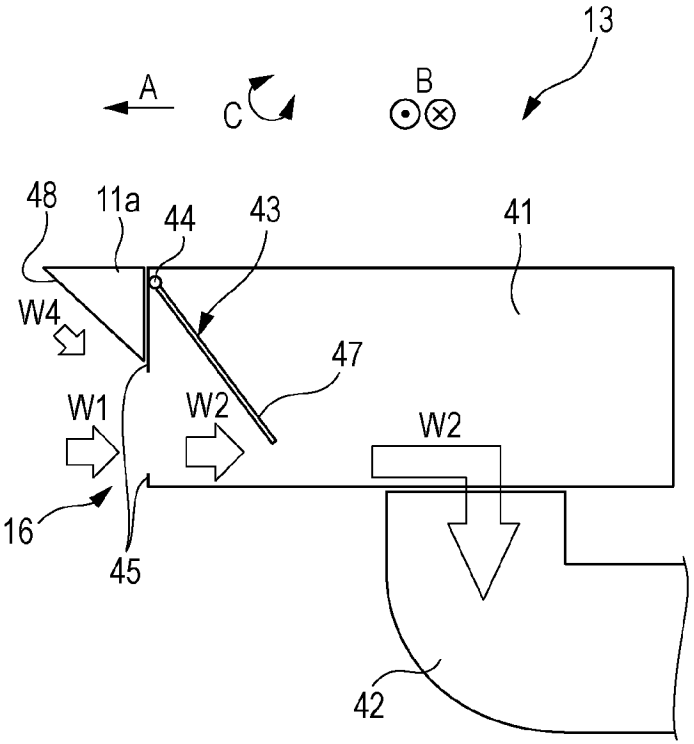

FIGS. 18A and 18B

Subsequently, a recording apparatus according to a third embodiment will be described.

FIGS. 18A and 18B are schematic side sectional views of peripheral portions of a collecting unit 13 as a main portion of a recording apparatus 1 according to the third embodiment. In addition, FIG. 18A in FIGS. 18A and 18B is a schematic side sectional view when recording is not performed (state in which ink is not ejected from recording head 7), and FIG. 18B is a schematic side sectional view when recording is performed. In addition, FIGS. 18A and 18B correspond to FIGS. 16A and 16B which illustrate schematic side sectional views of peripheral portions of the collecting unit 13 as a main portion of a recording apparatus 1 according to the first embodiment.

In addition, constituent elements which are common to those in the first and second embodiments will be given the same reference numerals, and detailed descriptions thereof will be omitted.

Only a configuration of a pipe 11*a* in the recording apparatus 1 according to the embodiment is different from that in the recording apparatus 1 according to the first embodiment.

As illustrated in FIGS. 18A and 18B, the pipe 11*a* according to the embodiment includes a slope portion 48. In addition, as illustrated in FIG. 18A, it is a configuration in which an air current W4 which is a part of air current which is sent from an air blowing unit 12 can be induced toward a collecting port 16 along the slope portion 48. That is, the recording apparatus 1 according to the embodiment has a configuration in which it is possible to efficiently induce mist toward the collecting unit 13 by including the slope portion 48 as an inducing unit which induces mist of ink toward the collecting port 16.

In addition, the invention is not limited to the above described embodiment, and it is needless to say that the invention can be variously modified in the scope of the invention which is described in claims, and those are also included in the scope of the invention.

Hitherto, the invention has been described based on specific embodiments. Here, the invention will be collectively described once again.

A liquid ejecting apparatus 1 according to a first aspect of the invention includes the ejecting unit 7 which ejects liquid, and the collecting unit 13 which collects mist which occurs along with ejecting of the liquid from the recording head 7 from the collecting port 16, in which the collecting unit 13 includes the backflow prevention unit 43 in the collecting port 16.

According to the aspect, the collecting unit 13 includes the backflow prevention unit 43 in the collecting port 16. For this reason, it is possible to suppress backflow of mist of liquid from the collecting unit 13.

In the liquid ejecting apparatus 1 according to a second aspect of the invention, in the first aspect, the backflow prevention unit 43 includes the rotating unit 47, and the regulation unit 45 which regulates rotating of the rotating unit 47 in a direction which goes toward the outside from the inside of the collecting unit 13, in which the rotating unit 47 can open or close the collecting port 16 by being rotated, the collecting port 16 is closed due to the rotating unit 47 when the rotating unit is at a position of being regulated by the regulation unit 45, and the collecting port 16 is opened when the rotating unit 47 is at a position of not being regulated by the regulation unit 45.

According to the aspect, the backflow prevention unit 43 includes the rotating unit 47, and the regulation unit 45 which regulates rotating of the rotating unit 47 in the direction which goes toward the outside from the inside of the collecting unit 13. In addition, the rotating unit 47 can open or close the collecting port 16 by being rotated, the collecting port 16 is closed due to the rotating unit 47 when the rotating unit is at a position of being regulated by the regulation unit 45, and the collecting port 16 is opened when the rotating unit 47 is at a position of not being regulated by the regulation unit 45. For this reason, it is possible to suppress backflow of mist of liquid from the collecting unit 13.

In the liquid ejecting apparatus 1 according to a third aspect of the invention, in the first or second aspect, the backflow prevention space 49 in which backflow of mist which is caused by an occurrence of turbulence in the air current W2 which is generated along with collecting of the mist from the collecting port 16 is suppressed is provided inside the collecting unit 13.

According to the aspect, the backflow prevention space 49 in which backflow of mist which is caused by an occurrence of turbulence in the air current W2 which is generated along with collecting of the mist from the collecting port 16 is suppressed is provided inside the collecting unit 13. That is, the collecting unit 13 is provided with a sufficiently large space in the inside so that mist does not flow back. For this reason, it is possible to preferably suppress backflow of mist of liquid from the collecting unit 13.

In the liquid ejecting apparatus 1 according to a fourth aspect of the invention, in any one of the first to third aspects, an inducing unit 48 which induces the mist toward the collecting port 16 is provided.

According to the aspect, the inducing unit 48 which induces the mist toward the collecting port 16 is provided. For this reason, it is possible to efficiently induce mist toward the collecting unit 13.

In the liquid ejecting apparatus 1 according to a fifth aspect of the invention, in any one of the first to fourth aspects, the collecting unit 13 includes the suctioning unit 15 which generates the air current W2 from the collecting port 16 toward the inside of the collecting unit 13.

According to the aspect, the collecting unit 13 includes the suctioning unit 15 which generates the air current W2 from the collecting port 16 toward the inside of the collecting unit 13. For this reason, it is possible to preferably suppress backflow of mist of liquid from the collecting unit 13.

In the liquid ejecting apparatus 1 according to a sixth aspect of the invention, in any one of the first to fifth aspects, the air blowing unit 12 which blows air from the inside of the collecting unit 13 toward the collecting port 16 is provided.

According to the aspect, the air blowing unit 12 which blows air from the inside of the collecting unit 13 toward the collecting port 16 is provided. For this reason, it is possible to efficiently induce mist toward the collecting unit 13.

In the liquid ejecting apparatus 1 according to a seventh aspect of the invention, in any one of the first to sixth aspects, the ejecting unit 7 can eject the liquid while reciprocating in the reciprocating direction B, and the air blowing unit 12 stops air blowing when the ejecting unit 7 is moving in the reciprocating direction B, and performs air blowing when the ejecting unit 7 is stopped.

According to the aspect, the ejecting unit 7 can eject the liquid while reciprocating in the reciprocating direction B, and the air blowing unit 12 stops air blowing when the ejecting unit 7 is moving in the reciprocating direction B, and performs air blowing when the ejecting unit 7 is stopped. That is, the air blowing unit stops air blowing while liquid is ejected from the ejecting unit 7, and performs air blowing while liquid is not ejected from the ejecting unit 7. For this reason, it is possible to collect mist while suppressing an occurrence of a shift in ejecting position of liquid which is ejected from the recording head 7.

In the liquid ejecting apparatus 1 according to an eighth aspect of the invention, in the fifth aspect, the ejecting unit 7 can eject the liquid while reciprocating in the reciprocating direction B, and the suctioning unit 15 maintains a suctioning state in both cases of a case in which the ejecting unit 7 is moving in the reciprocating direction and a case in which the ejecting unit 7 is stopped.

According to the aspect, the ejecting unit 7 can eject liquid while reciprocating in the reciprocating direction B, and the suctioning unit 15 maintains a suctioning state in both cases of the case in which the ejecting unit 7 is moving in the reciprocating direction and the case in which the ejecting unit 7 is stopped. That is, the suctioning unit 15 is set to a constant suctioning state. Since there is no shift in ejecting position of liquid even when the air current W2 is generated inside the collecting unit 13 using the suctioning unit 15, it is possible to preferably suppress backflow of mist of liquid from the collecting unit 13, while suppressing a shift in ejecting position of liquid which is ejected from the ejecting unit 7 by setting the suctioning unit 15 to a constant suctioning state.

In the liquid ejecting apparatus 1 according to a ninth aspect, in any one of the first to fourth aspects, the air blowing unit 12 which blows air from the outside of the collecting unit 13 toward the collecting port 16 is provided, in which the collecting unit 13 includes the suctioning unit 15 which generates an air current from the collecting port 16 toward the inside of the collecting unit 13, and a wind velocity of the air current W1 which goes from the outside of the collecting unit 13 toward the collecting port 16 by interposing the collecting port 16 is set to be lower than a wind velocity of the air current W2 which goes from the collecting port 16 toward the inside of the collecting unit 13.

According to the aspect, the air blowing unit 12 which blows air from the outside of the collecting unit 13 toward the collecting port 16 is provided, in which the collecting unit 13 includes the suctioning unit 15 which generates an air current W2 from the collecting port 16 toward the inside of the collecting unit 13, and a wind velocity of the air current W1 which goes from the outside of the collecting unit 13 toward the collecting port 16 by interposing the collecting port 16 is set to be lower than a wind velocity of the air current W2 which goes from the collecting port 16 toward the inside of the collecting unit 13. That is, it is set so that a wind velocity of the air current W2 which goes from the collecting port 16 toward the inside of the collecting unit 13 is higher than a wind velocity of the air current W1 which goes from the outside of the collecting unit 13 toward the collecting port 16 based on a position of the collecting port 16. For this reason, it is possible to suppress a situation in which the air current W1 including mist is incapable of entering the collecting unit 13 as a whole, and to preferably suppress backflow of mist of liquid from the collecting unit 13.

The entire disclosure of Japanese Patent Application No. 2015-057822, filed Mar. 20, 2015 is expressly incorporated by reference herein.

What is claimed is:

1. A liquid ejecting apparatus comprising:

an ejecting unit which ejects liquid onto a recording medium; and a collecting unit which collects mist which occurs along with ejecting of the liquid from the ejecting unit from a collecting port, the collecting unit being disposed upstream of the ejecting unit in a conveying direction of the recording medium; and an air blowing unit which blows air from the outside of the collecting unit toward the collecting port;

wherein the collecting unit includes a backflow prevention unit in the collecting port, wherein the backflow prevention unit is disposed in a path of the air such that air blown from the blowing unit reaches the backflow prevention unit prior to the collecting unit.

2. The liquid ejecting apparatus according to claim 1, wherein the backflow prevention unit includes a rotating unit, and a regulation unit which regulates rotating of the rotating unit in a direction which goes toward the outside from the inside of the collecting unit, and wherein the rotating unit is configured to open or close the collecting port by being rotated, the collecting port is closed due to the rotating unit when the rotating unit is at a position of being regulated by the regulation unit, and the collecting port is opened when the rotating unit is at a position of not being regulated by the regulation unit.

3. The liquid ejecting apparatus according to claim 1, wherein a backflow prevention space in which backflow of mist which is caused by an occurrence of turbulence in an air current which is generated along with collecting of the mist from the collecting port is suppressed is provided inside the collecting unit.

4. The liquid ejecting apparatus according to claim 1, further comprising:

an inducing unit which induces the mist toward the collecting port.

5. The liquid ejecting apparatus according to claim 1, wherein the collecting unit includes a suctioning unit which generates an air current from the collecting port toward the inside of the collecting unit.

6. The liquid ejecting apparatus according to claim 5, wherein the ejecting unit is configured to eject the liquid while reciprocating in the reciprocating direction, and wherein the suctioning unit maintains a suctioning state in both cases of a case in which the ejecting unit is moving in the reciprocating direction and a case in which the ejecting unit is stopped.

7. The liquid ejecting apparatus according to claim 1, wherein the ejecting unit is configured to eject the liquid while reciprocating in a reciprocating direction, and wherein the air blowing unit stops air blowing when the ejecting unit is moving in the reciprocating direction, and performs air blowing when the ejecting unit is stopped.

8. The liquid ejecting apparatus according to claim 1, further comprising:

an air blowing unit which blows air from the outside of the collecting unit toward the collecting port, wherein the collecting unit includes a suctioning unit which generates an air current from the collecting port toward the inside of the collecting unit, and wherein a wind velocity of an air current which goes from the outside of the collecting unit toward the collecting port by interposing the collecting port is lower than a wind velocity of an air current which goes from the collecting port toward the inside of the collecting unit.

* * * * *